US008091605B1

(12) United States Patent
Melhart

(10) Patent No.: US 8,091,605 B1
(45) Date of Patent: Jan. 10, 2012

(54) ACOUSTIC PANEL ASSEMBLY

(75) Inventor: Jimmie Ray Melhart, McAllen, TX (US)

(73) Assignee: Jim Melhart Piano and Organ Company, McAllen, TX (US)

( * ) Notice: Subject to any disclaimer, the term of this patent is extended or adjusted under 35 U.S.C. 154(b) by 342 days.

(21) Appl. No.: 11/627,331

(22) Filed: Jan. 25, 2007

Related U.S. Application Data

(60) Provisional application No. 60/762,183, filed on Jan. 25, 2006.

(51) Int. Cl.
*A47G 5/00* (2006.01)

(52) U.S. Cl. ..... 160/135; 160/351

(58) Field of Classification Search ..... 160/135, 160/351

See application file for complete search history.

(56) References Cited

U.S. PATENT DOCUMENTS

| | | | | | |
|---|---|---|---|---|---|
| 847,287 | A | * | 3/1907 | King | 160/135 |
| 1,085,500 | A | * | 1/1914 | Shoberg | 160/135 |
| 1,700,637 | A | * | 1/1929 | Lamb | 160/244 |
| 2,120,979 | A | | 6/1938 | Hunt | |
| 3,126,049 | A | * | 3/1964 | Hollands | 160/40 |
| 3,180,446 | A | * | 4/1965 | Wenger | 181/30 |
| 3,232,370 | A | * | 2/1966 | Jaffe | 181/30 |
| 3,553,871 | A | * | 1/1971 | Benchley, Jr. | 40/607.1 |
| 3,592,288 | A | | 7/1971 | Walter | |
| 3,630,309 | A | * | 12/1971 | Wenger et al. | 181/30 |
| 3,908,787 | A | * | 9/1975 | Wenger et al. | 181/30 |
| 3,975,850 | A | * | 8/1976 | Giaume | 406/10 |
| 4,121,645 | A | * | 10/1978 | Behr | 160/135 |
| 4,241,777 | A | * | 12/1980 | Wenger et al. | 160/135 |
| 4,278,145 | A | * | 7/1981 | Eade et al. | 181/30 |
| 4,290,332 | A | * | 9/1981 | Schoeffling, Jr. | 84/723 |
| 4,444,240 | A | * | 4/1984 | Bannister | 160/135 |
| D277,584 | S | * | 2/1985 | Annestedt | D20/43 |
| 4,667,833 | A | * | 5/1987 | Jamison | 211/198 |
| 4,785,565 | A | * | 11/1988 | Kuffner | 40/605 |
| 5,007,473 | A | * | 4/1991 | Evensen | 160/135 |
| 5,069,011 | A | * | 12/1991 | Jenne | 52/144 |
| D323,338 | S | | 1/1992 | Court | |
| 5,220,952 | A | * | 6/1993 | Beaulieu | 160/231.1 |
| 5,400,551 | A | | 3/1995 | Uhl | |
| 5,403,979 | A | * | 4/1995 | Rogers et al. | 181/30 |
| 5,613,543 | A | | 3/1997 | Walton | |
| 5,651,405 | A | * | 7/1997 | Boeddeker et al. | 160/135 |
| 5,819,961 | A | * | 10/1998 | Harris | 211/196 |
| 5,875,597 | A | * | 3/1999 | Gingrich et al. | 52/239 |
| 6,085,861 | A | * | 7/2000 | Jines | 181/30 |
| 6,584,736 | B2 | * | 7/2003 | Szymanski et al. | 52/145 |
| 6,643,966 | B2 | * | 11/2003 | Schmitt | 40/610 |

(Continued)

OTHER PUBLICATIONS

Wenger Corporation, "Travelmaster Acoustical Shell", pp. 64-65; 2001 (4 pages).

*Primary Examiner* — Blair M Johnson
*Assistant Examiner* — Jaime F Cardenas-Garcia
(74) *Attorney, Agent, or Firm* — Cox Smith Matthews Incorporated

(57) ABSTRACT

An acoustic panel assembly may have one or more panels adaptable for reflecting sound waves and a support member to which the one or more panels may be attached. The support member may be extendable and retractable. The one or more panels and the support member may be collapsible into a housing. The one or more panels may be configured in one or more substantially planar portions, one or more substantially curved portions, or a combination thereof.

12 Claims, 10 Drawing Sheets

U.S. PATENT DOCUMENTS 7,337,567 B2 * 3/2008 Fritsche et al. ..... 40/603
7,350,772 B2 * 4/2008 Legrand ..... 256/25
7,530,543 B1 * 5/2009 Kremzar ..... 248/441.1
7,600,608 B2 * 10/2009 Freiheit ..... 181/287
2002/0194792 A1 * 12/2002 Feldpausch et al. ..... 52/36.1
2006/0037719 A1 * 2/2006 Dalling ..... 160/135

* cited by examiner

ACOUSTIC PANEL ASSEMBLY

CROSS REFERENCE TO RELATED APPLICATIONS

This application claims the benefit of U.S. Provisional Patent Application No. 60/762,183 filed Jan. 25, 2006, the disclosure of which is incorporated herein by reference.

BACKGROUND

This application relates to the field of acoustic panels.

SUMMARY

An acoustic panel assembly may have one or more panels adaptable for reflecting sound waves and a support member to which the one or more panels may be attached. The support member may be extendable and retractable. The one or more panels and the support member may be collapsible into a housing. The one or more panels may be configured in one or more substantially planar portions, one or more substantially curved portions, or a combination thereof. Such an acoustic panel assembly is useful for placement behind one or more musical performers, such as a choir, band, or orchestra, for example, in order to reflect or deflect sound waves in desired directions for improved acoustic quality.

DETAILED DESCRIPTION

As used herein, the following terms should be understood to have the indicated meanings:

When an item is introduced by "a" or "an," it should be understood to mean one or more of that item.

"Attachment" means a connection between or among two or more items, either directly or indirectly through one or more intermediate items. An attachment may be formed by any suitable means, including but not limited to a mechanical connection, a magnetic connection, a chemical connection, or a combination thereof.

"Comprises" means includes but is not limited to.

"Comprising" means including but not limited to.

"Connected" means linked together, either directly or indirectly through one or more intermediate items. Two or more items may be connected in any suitable manner, including but not limited to integral formation and attachment.

"Having" means including but not limited to.

"Hinge" means a connection that permits rotation.

"Hingedly connected" means connected in a manner to permit rotation.

"Housing" means a generally hollow structure adaptable for containing one or more objects. A housing may or may not have an enclosed space and may have any desired shape, including but not limited to rectangular, cubic, triangular, polygonal, spherical, ovoid, or a combination thereof.

"Panel" means a structure having one or more surfaces adaptable for reflecting sound waves. A panel may be made of any suitable material, such as cloth, canvas, plastic, fiberglass, wood, metal, composites, or a combination thereof, and may or may not be thin, flat, or flexible.

"Scissor-like support member" means a combined structure that has two or more elongated members which are connected together in a manner to permit relative rotation with respect to each other such that a dimension of such combined structure may be varied.

"Screen" means a thin, flexible panel.

"Spool" means an elongated structure adaptable for being rotated about a longitudinal axis and which is capable of carrying a rolled sheet of flexible material disposed thereon. A spool may have any desired cross-sectional shape, including but not limited to round, oval, elliptical, square, triangular, polygonal, irregular, or a combination thereof.

"Substantially co-planar" means, with respect to a first item and a second item, that each of the first and second items has a surface that lies in substantially the same plane as a surface of the other item. Substantially co-planar items may or may not be thin, may or may not be flat, and may or may not have opposing parallel surfaces.

"Telescoping member" means an elongated structure that is adaptable for longitudinal movement relative to one or more other members within which such elongated structure is at least partially disposed.

Figure 4:
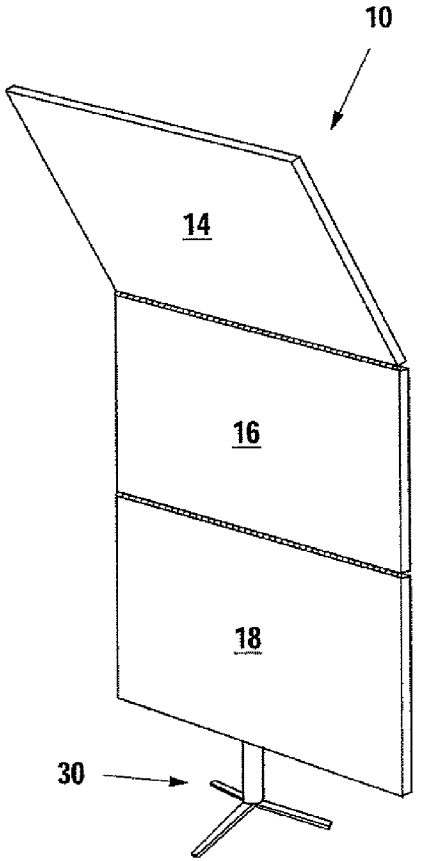
FIG. 4 is a perspective view of an acoustic panel assembly formed by mounting the plurality of panels of FIG. 1 on the stand of FIG. 3.
Figure 3:
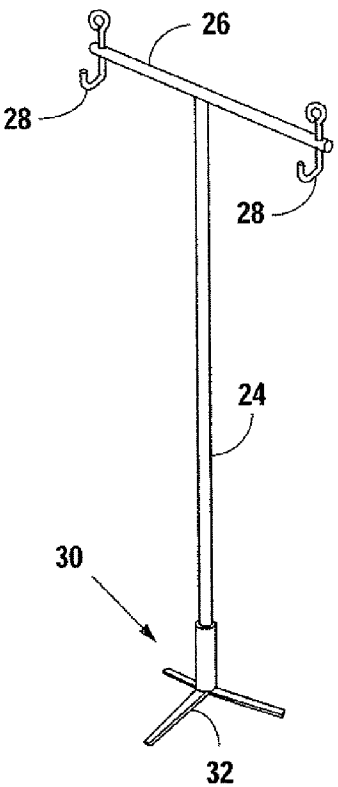
FIG. 3 is a perspective view of a stand on which a plurality of panels may be mounted to form an acoustic panel assembly.
Figure 1:
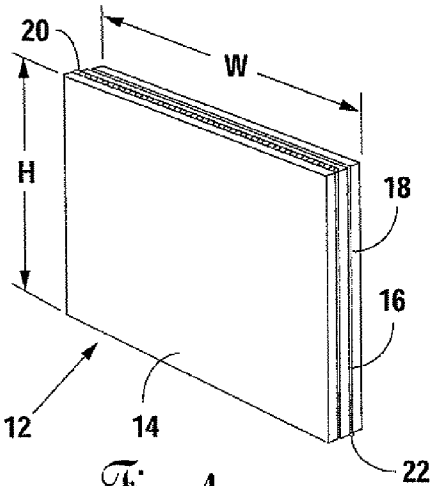
FIG. 1 is a perspective view of a plurality of panels for an acoustic panel assembly in a folded position.
Figure 2:
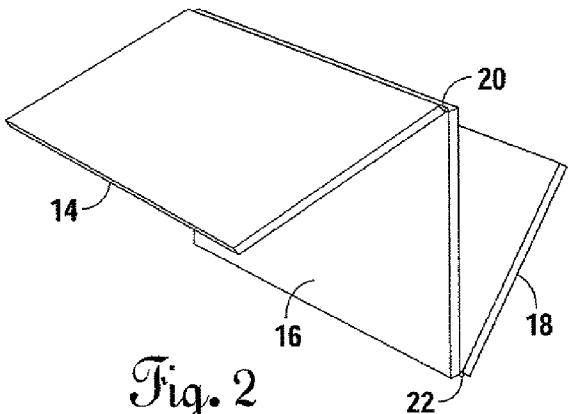
FIG. 2 is a perspective view of the plurality of panels of FIG. 1 in a partially unfolded position.
Figure 5:
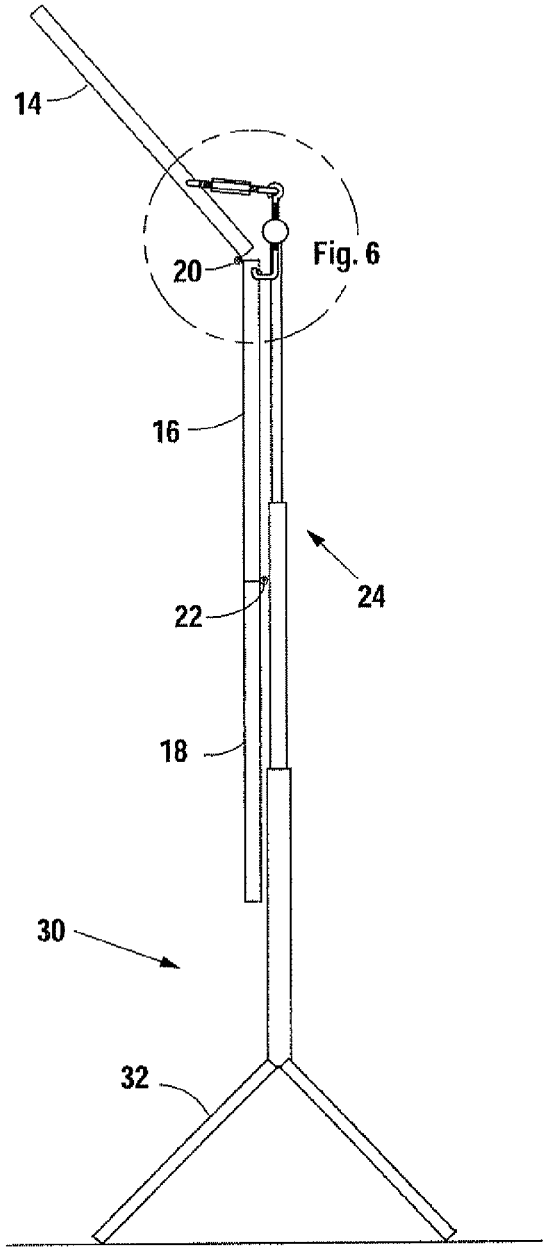
FIG. 5 is a side view of the acoustic panel assembly of FIG. 4.

As shown in FIGS. 1 through 4, an acoustic panel assembly 10 may be made from a plurality of panels 12 that are hinged together to permit the assembly to be folded up into a relatively compact folded position as shown in FIG. 1. The plurality of panels 12 may be unfolded and hung on a stand 30 as shown in FIGS. 3 and 4. Such an acoustic panel assembly 10 is useful for placement behind one or more musical performers, such as a choir, band, or orchestra, for example, in order to reflect or deflect sound waves in desired directions for improved acoustic quality. Each panel 14, 16, 18 of the plurality of panels 12 may be made from any suitable material, such as a light-weight ABS plastic material, and fastened to a relatively rigid frame (not shown) made of any suitable material, such as aluminum tube of any desired cross-sectional shape. For example, in one embodiment, each panel 14, 16, 18 may be about 36.0 inches tall (height H), 40.0 inches wide (width W), and made from ABS plastic having a thickness of about 0.125 in., and each panel may be fastened to a frame made of extruded aluminum tube having a 1.0 in. square cross-section and 0.050 in. wall thickness. Such an embodiment may weigh approximately 30.0 pounds and may be easily installed on a telescoping stand 30 by one person, as discussed further below. The frame of the middle panel 16 may be hinged to the frame of each of the lower and upper panels 14, 18 in any suitable manner, such as with hinges 20 and 22, so that the panel assembly may be folded and unfolded as shown in FIGS. 1 and 2. One or more hinges 20, 22 of any desired type may be used to attach the panels 14, 16, 18 together, and the one or more hinges 20, 22 may be placed along the entire width of the panels 14, 16, 18, or only along certain portions of the panels 14, 16, 18 as desired. As shown in FIGS. 4 and 5, in an extended position, panels 16 and 18 may be substantially co-planar, and panel 14 may be oriented at an angle with respect to panels 16 and 18. Although the embodiment illustrated in FIGS. 1 through 4 comprises three panels 14, 16, 18, persons of ordinary skill in the art will recognize that fewer than three or more than three panels may be used. Persons of ordinary skill in the art will also recognize that the panels 14, 16, 18 may be made of any desirable shape, size, and materials, and the shapes, sizes, and materials described herein are exemplary and not limiting. For example, the panels 14, 16, 18 may be made of plastic materials other than ABS plastic, such as nylon, polyester, PVC, polyethylene, plexiglass, acrylic or similar materials, as well as other materials such as fiberglass, metal, wood, composites, or combinations thereof. Likewise, the panel frames may be made of any suitable material other than aluminum, such as steel, wood, titanium, other metals, fiberglass, plastic, composites, or combinations thereof.

Figure 6:
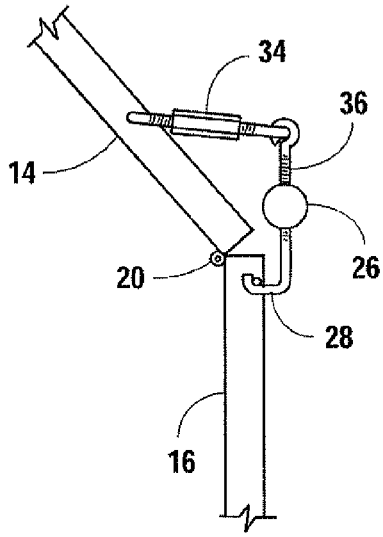
FIG. 6 is an enlarged detailed view of a portion of the acoustic panel assembly of FIG. 5.

Referring to FIGS. 3, 5, and 6, a stand 30 on which a plurality of panels 12 may be mounted may comprise a tripod base 32 with a telescoping vertical member 24 and a horizontal cross bar 26. The cross bar 26 may have one or more attachments, such as J-bolts 28 or other suitable attachments, for attaching the plurality of panels 12 to the stand 30. In the embodiment shown in FIGS. 3, 5, and 6, two J-bolts 28 are provided on the cross bar 26 for mating with the middle panel 16 in a suitable manner. For example, the frame of the middle panel 16 may have a pair of holes, hooks, or other receptacles for receiving the J-bolts 28. Of course, any other suitable means of attachment may be used to fasten the panels 14, 16, 18 to the stand 30. The position of the upper panel 14 may be adjustable with respect to the middle panel 16 in order to tilt forward toward the one or more musical performers as known in the art. For example, an eye-bolt 36 may be provided on the cross bar 26, and a link comprising a turnbuckle 34 may be connected between the eye-bolt 36 and the upper panel 14. By adjusting the turnbuckle 34, the angle of the upper panel 14 may be adjusted. Of course, any other suitable means of adjustment may be provided, such as a hinge with multiple detents, a pivoting bar with multiple connection positions on the upper panel, a cord, or a telescoping member. In one embodiment, a conventional light tree may be used as a stand. Alternatively, other base arrangements may be used, such as those with fewer or more than three legs, or bases with no legs. Likewise, other vertical members and cross bars may be used, each of which may be either adjustable or nonadjustable. Although the embodiment illustrated in FIGS. 3, 5, and 6 has one vertical member 24 and one cross bar 26, more than one vertical member 24 and more than one cross bar 26 may be used if desired. Also, such structural members on which the plurality of panels 12 is mounted need not be oriented vertically or horizontally, but may be in any desired orientation.

Figure 7:
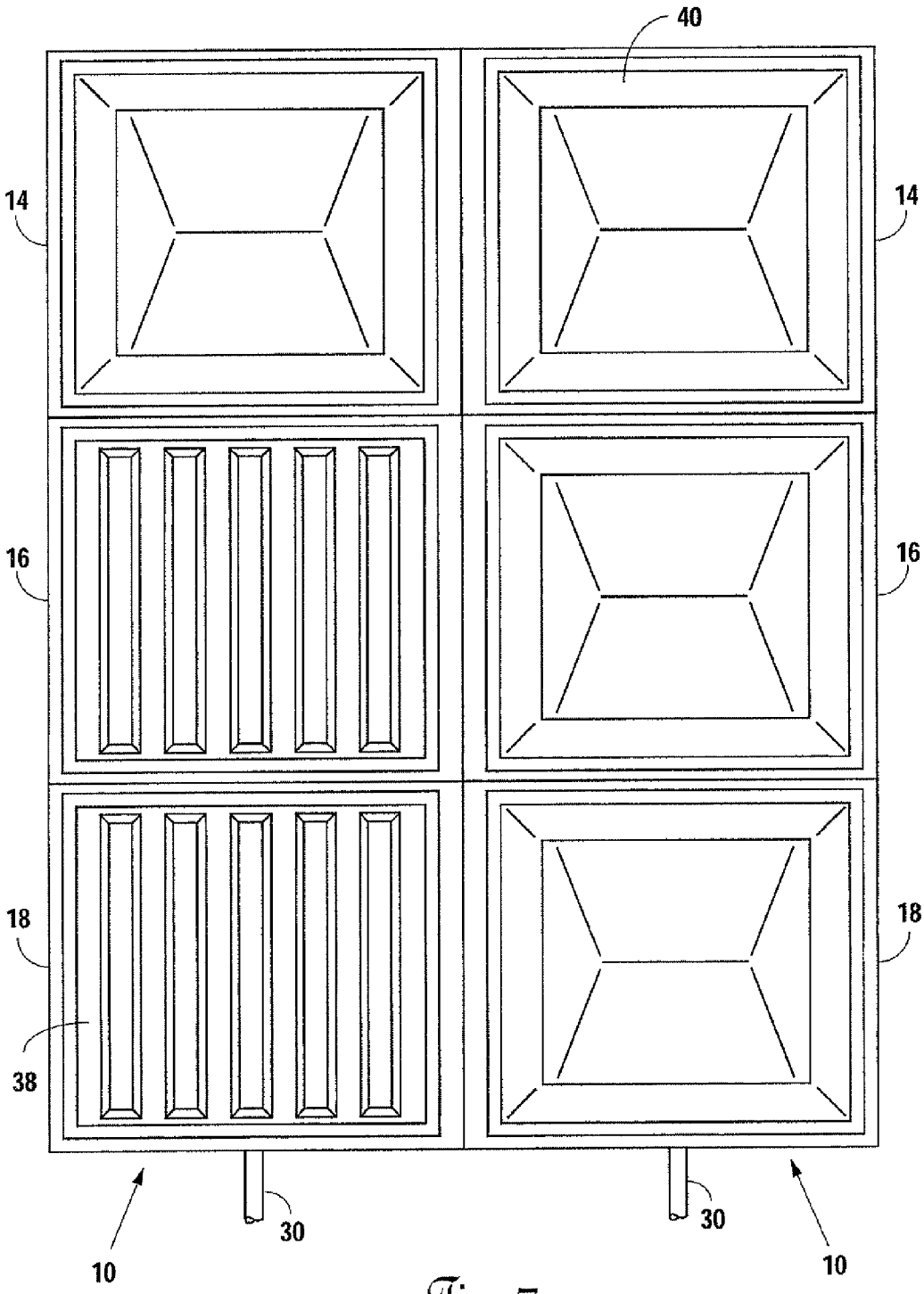
FIG. 7 is a front view of two acoustic panel assemblies positioned adjacent to each other.
Figure 8:
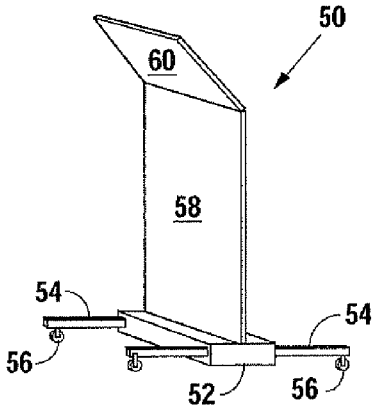
FIG. 8 is a perspective view of an alternative embodiment of an acoustic panel assembly in a deployed position.

Referring to FIG. 7, multiple panel assemblies 10 may be placed side by side in order to form an acoustic wall. Some or all of the panels of the various panel assemblies 10 may be either flat or may have various surface features, such as raised or depressed regions 38, 40 as shown in FIG. 7, to deflect sound in various desired directions. Persons of ordinary skill in the art will appreciate that patterns and arrangements of surface features other than those shown in FIG. 7 may be used, including irregular features as well as patterned features.

To use an acoustic panel assembly 10 as described herein, a user may unfold the plurality of panels 12 as shown in FIGS. 1 and 2 and place the plurality of panels 12 on a stand 30 as shown in FIGS. 3 through 6. In one embodiment, each panel 14, 16, 18 may be approximately 36.0 inches tall and 40.0 inches wide, the plurality of panels 12 may weigh about 30.0 pounds, and the stand 30 may be approximately six feet tall in a retracted position. With such an embodiment, one person may easily place the plurality of panels 12 on the stand 30, adjust the upper panel 14 to a desired angle as described above, and then raise the telescoping vertical member 24 in order to place the upper panel 14 at a desired height. The panel assembly 10 may be disassembled in reverse order. When in a folded position as shown in FIG. 1, the plurality of panels 12 is compact, easy to move, and does not require much storage space.

Figure 9:
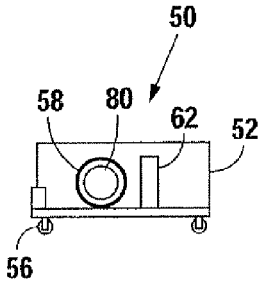
FIG. 9 is a side view of the acoustic panel assembly of FIG. 8 in a retracted position.
Figure 10:
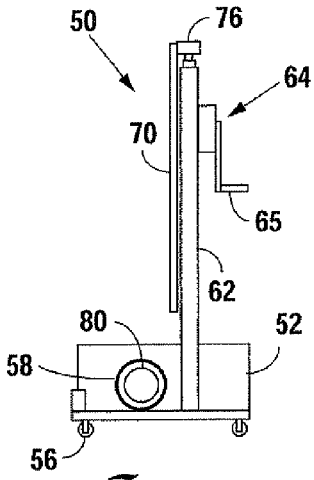
FIG. 10 is a side view of the acoustic panel assembly of FIG. 8 in a partially deployed position.
Figure 11:
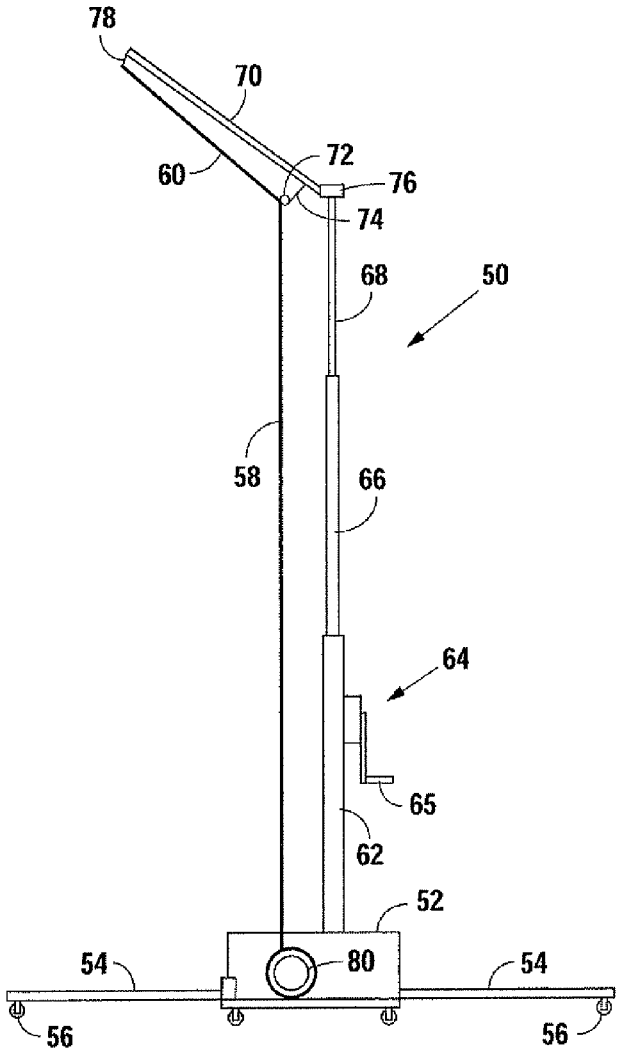
FIG. 11 is a side view of the acoustic panel assembly of FIG. 8.
Figure 12:
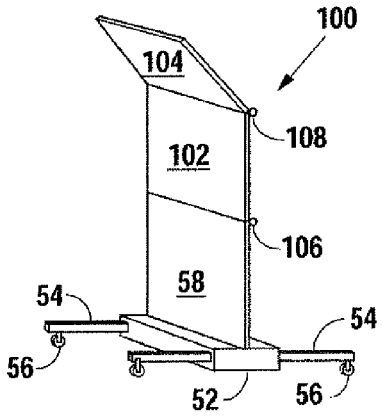
FIG. 12 is a perspective view of another alternative embodiment of an acoustic panel assembly in a deployed position.

An alternative embodiment of an acoustic panel assembly 50 is illustrated in FIGS. 8-11. Acoustic panel assembly 50 may have a housing 52 with a plurality of extendable and retractable legs 54, which may or may not have one or more wheels 56 to facilitate easy movement of acoustic panel assembly 50. For example, legs 54 may be pivotally mounted to housing 52, and one or more locks or detents may be provided for holding legs 54 in any desired extended, partially extended, or retracted position. Acoustic panel assembly 50 may have one or more retractable and extendable support members 62 mounted therein. Such support members 62 may be mounted in housing 52 such that they may be moved from a stowed position as shown in FIG. 9 to a deployed position as shown in FIGS. 10 and 11. For example, support members 62 may be pivotally mounted in housing 52, and one or more locks or detents may be provided to hold support members 62 in any desired stowed, deployed, or partially deployed position. A crank 64 with a handle 65 may be provided for manually extending and retracting one or more extensible members 66, 68 of support member 62. Alternatively or additionally, extension and retraction of extensible members 66, 68 may be accomplished by any desired automatic means, such as one or more electric motors, solenoids, hydraulic systems, pneumatic systems, or the like, for example. Support member 62 may have a joint 76 to which an upper support member 70 is attached in a manner to permit movement between a folded position as shown in FIG. 10 and an extended position as shown in FIG. 11. Joint 76 may be a pivot connection, for example, and may have one or more locks or detents to hold upper support member 70 in any desired position, such as those positions illustrated in FIGS. 10 and 11, for example. A flexible screen 58 may be rolled onto a spool 80 that is mounted in housing 52. Screen 58 may be attached to support member 62 with one or more attachments 74, 78 so that screen 58 will unroll from spool 80 when support member 62 is extended, and spool 80 may have a winding mechanism, such as a torsion spring or other suitable mechanism, so that screen 58 will roll back up on spool 80 when support member 62 is retracted. A rod 72 or other suitable member may be attached to screen 58 at or near attachment 74 in order to form an upper section 60 of screen 58 that may be positioned at any desired angle with respect to the remainder of screen 58.

Persons of ordinary skill in the art will appreciate that acoustic panel assembly 50 may be readily assembled, positioned, and used to reflect sound much like acoustic panel assembly 10 described above. Acoustic panel assembly 50 may also be readily retracted into a stowed position as shown in FIG. 9 such that it takes up very little space and is easily moved. Acoustic panel assembly 50 thus greatly simplifies and reduces the effort with which a user may set up, use, take down, and transport a sound reflecting apparatus.

Figure 13:
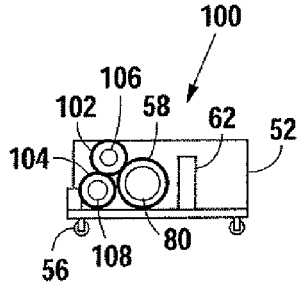
FIG. 13 is a side view of the acoustic panel assembly of FIG. 12 in a retracted position.
Figure 14:
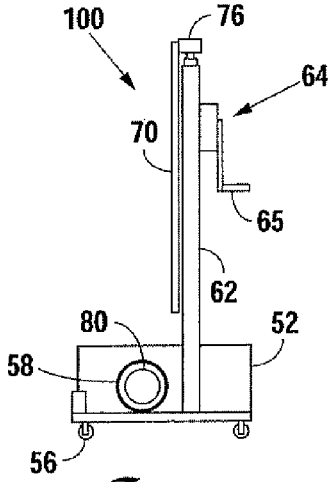
FIG. 14 is a side view of the acoustic panel assembly of FIG. 12 in a partially deployed position.
Figure 15:
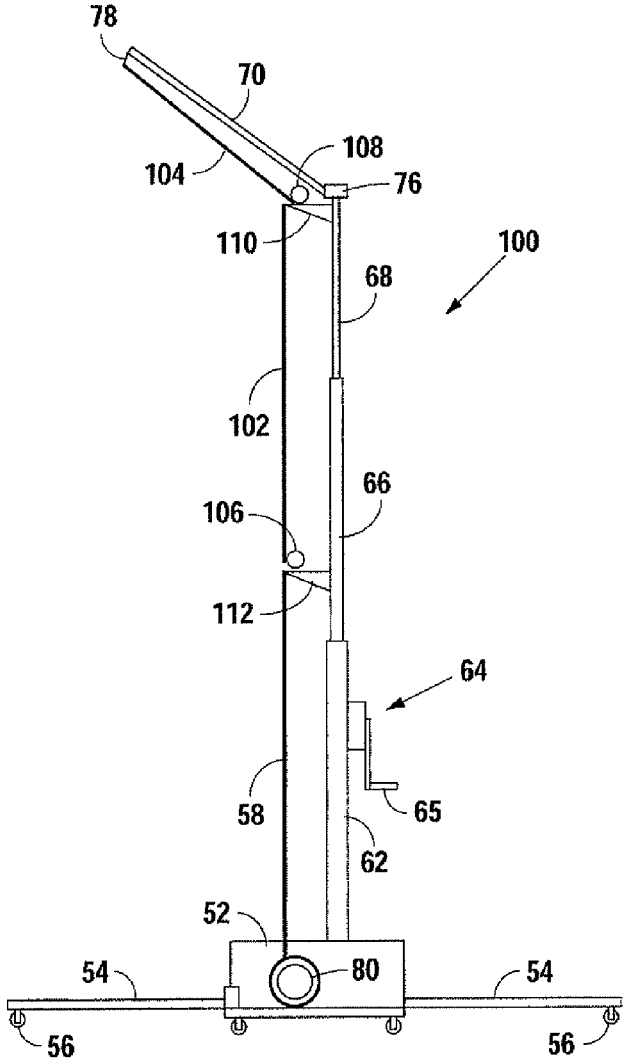
FIG. 15 is a side view of the acoustic panel assembly of FIG. 12.

Another alternative embodiment of an acoustic panel assembly 100 is illustrated in FIGS. 12-15. Acoustic panel assembly 100 may have a housing 52 with a plurality of extendable and retractable legs 54, which may or may not have one or more wheels 56 to facilitate easy movement of acoustic panel assembly 100 as described above for acoustic panel assembly 50. Also similar to acoustic panel assembly 50 described above, acoustic panel assembly 100 may have one or more retractable and extendable support members 62 mounted in housing 52 such that support members 62 may be moved from a stowed position as shown in FIG. 13 to a deployed position as shown in FIGS. 14 and 15. For example, support members 62 may be pivotally mounted in housing 52, and one or more locks or detents may be provided to hold support members 62 in any desired stowed, deployed, or partially deployed position. A crank 64 with a handle 65 may be provided for manually extending and retracting one or more extensible members 66, 68 of support member 62. Alternatively or additionally, extension and retraction of extensible members 66, 68 may be accomplished by any desired automatic means, such as one or more electric motors, solenoids, hydraulic systems, pneumatic systems, or the like, for example. Support member 62 may have a joint 76 to which an upper support member 70 is attached in a manner to permit movement between a folded position as shown in FIG. 14 and an extended position as shown in FIG. 15. Joint 76 may be a pivot connection, for example, and may have one or more locks or detents to hold upper support member 70 in any desired position, such as those positions illustrated in FIGS. 14 and 15, for example. Similar to acoustic panel assembly 50 described above, a flexible screen 58 may be rolled onto a spool 80 that is mounted in housing 52. Screen 58 may be attached to support member 62 with one or more attachments 112 so that screen 58 will unroll when support member 62 is extended, and spool 80 may have a winding mechanism, such as a torsion spring or other suitable mechanism, so that screen 58 will roll back up on spool 80 when support member 62 is retracted. One or more additional screens 102, 104 may be provided on one or more additional spools 106, 108, which may be stored in housing 52 when not in use and may be mounted to support member 62 with one or more attachments 110, 112, 78 when in use. One or more of the additional screens 102, 104 may be positioned at an angle with respect to screen 58 such as shown for screen 104 in FIG. 15 by attachment to upper support member 70. The additional screens 102, 104 may be placed on support member 62 before support member 62 is extended, and then support member 62 may be extended in order to position the additional screens 102, 104 at any desired height.

Once again, persons of ordinary skill in the art will appreciate that acoustic panel assembly 100 may be readily assembled, positioned, and used to reflect sound much like acoustic panel assembly 10 or 50 described above. Acoustic panel assembly 100 may also be readily retracted into a stowed position as shown in FIG. 13 such that it takes up very little space and is easily moved. Acoustic panel assembly 100 thus greatly simplifies and reduces the effort with which a user may set up, use, take down, and transport a sound reflecting apparatus.

Figure 16:
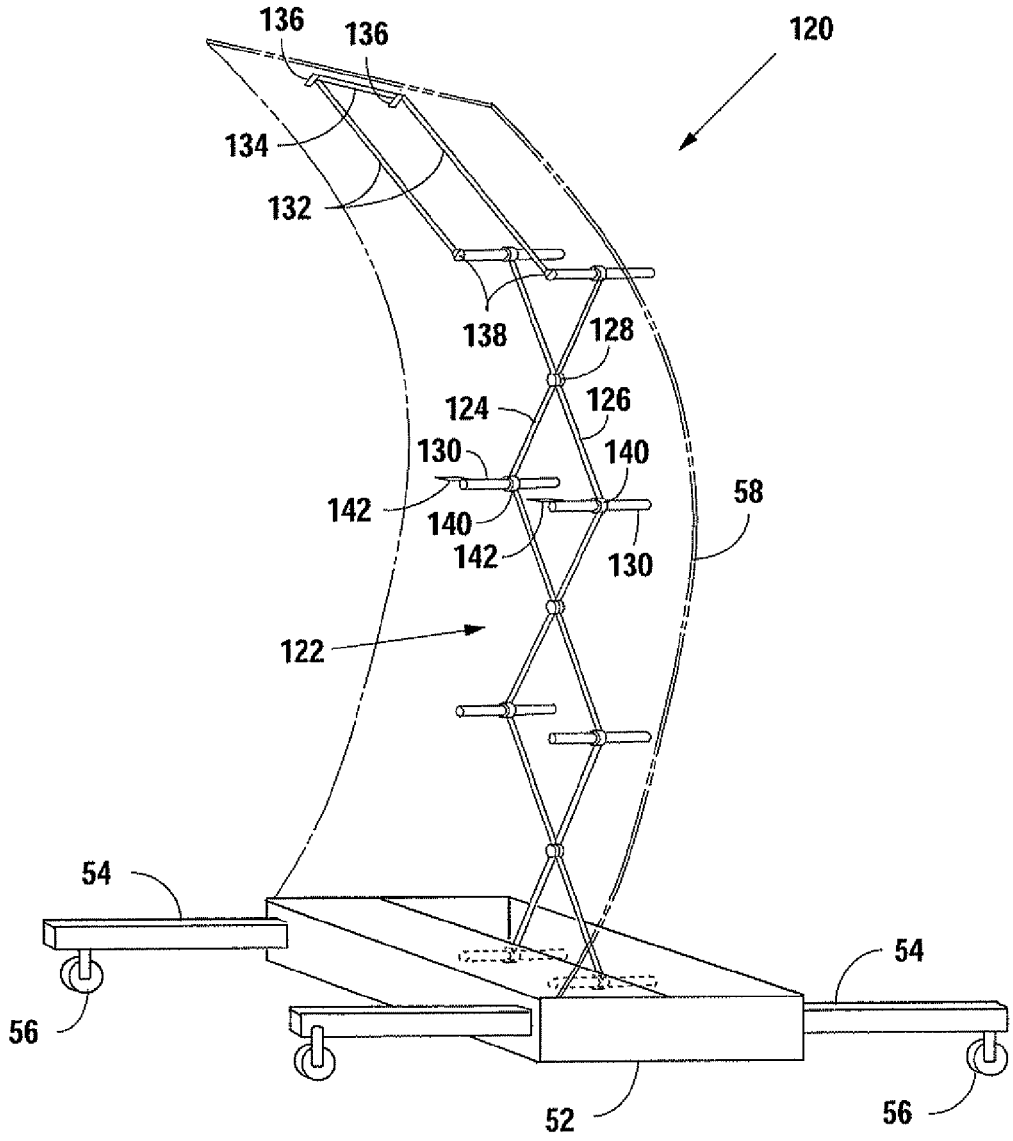
FIG. 16 is a perspective view of still another alternative embodiment of an acoustic panel assembly in a deployed position.
Figure 17:
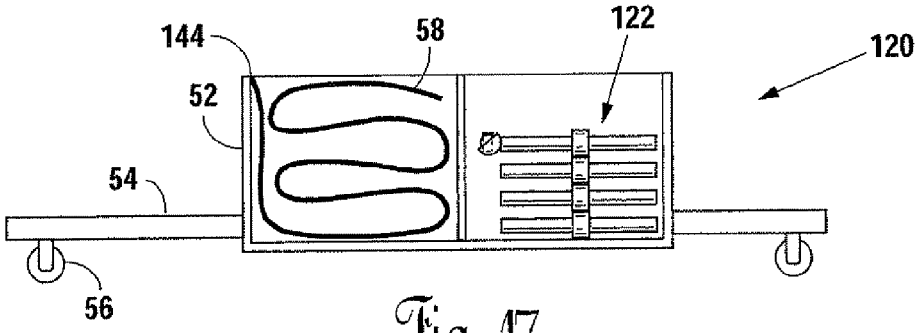
FIG. 17 is a side view of the acoustic panel assembly of FIG. 16 in a retracted position.
Figure 18:
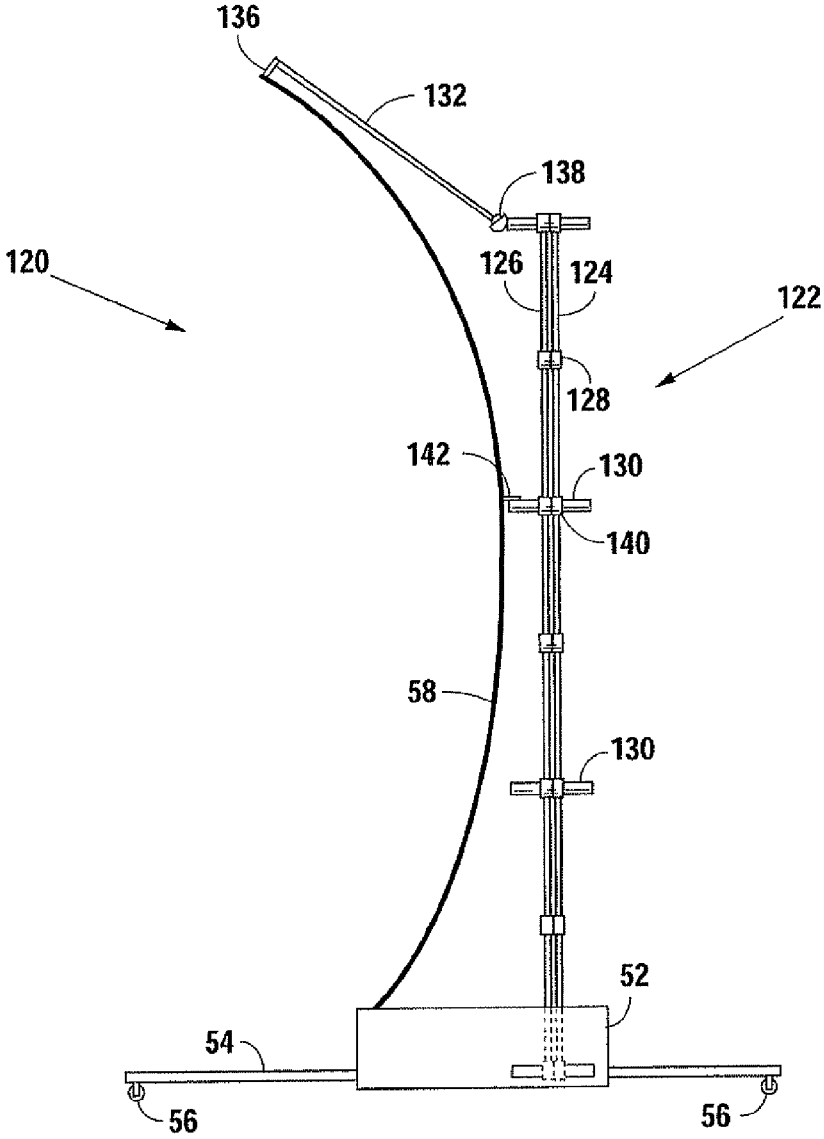
FIG. 18 is a side view of the acoustic panel assembly of FIG. 16.

Referring to FIGS. 16-18, another alternative embodiment of an acoustic panel assembly 120 is shown in which a flexible screen 58 is supported by a scissor-like support member 122 in a deployed position (see FIGS. 16 and 18). Flexible screen 58 may be disconnected from scissor-like support member 122 and folded upon itself and stowed within housing 52 in a retracted position as shown in FIG. 17. Similarly, scissor-like support member 122 may be collapsed upon itself and stowed within housing 52 in a retracted position as shown in FIG. 17. Scissor-like support member 122 may have one or more sets of arms 124, 126 that are pinned together at a joint 128, which may have one or more locks, detents, or other suitable mechanisms sufficient to hold arms 124, 126 in a desired position. If a plurality of sets of arms 124, 126 is provided, adjacent sets of arms 124, 126 may be pivotally connected at joints 140, which may be provided on lateral support arms 130. The bottom set of lateral support arms 130 may be mounted in housing 52 in such a manner as to permit side to side sliding motion of at least one of such arms 130 during deployment and retraction of scissor-like support member 122. One end of screen 58 may be attached to housing 52 at one or more attachments 144 (see FIG. 17), and the other end of screen 58 may be attached to scissor-like support member 122 at one or more attachments 136. Scissor-like support member 122 may have one or more upper support members 132, which may be pivotally connected at one or more joints 138. Joints 138 may have one or more locks, detents, or other suitable means for holding members 132 in a desired position. A cross support member 134 may be connected between members 132, and one or more attachments 136 may be provided for attaching screen 58 to scissor-like support member 122 at or near the top of screen 58. One or more intermediate attachments 142 may also be provided along the length of screen 58 in order to hold screen 58 in a desired position. For example, screen 58 may be held in a curved position, such as a parabolic position, in order to focus sound waves in a desired direction. Of course, screen 58 may be held in any desired position, and the configuration shown in the drawings is merely exemplary and not limiting. A user may easily set up acoustic panel assembly 120 by attaching screen 58 to scissor-like support member 122 as described herein and extending scissor-like support member 122 to a deployed position. A user may easily take down acoustic panel assembly 120 by retracting scissor-like support member 122 and detaching screen 58 from scissor-like support member 122. Scissor-like support member 122 may be actuated manually, such as with a hand crank and worm screw or other suitable gear operatively engaged therewith, or automatically, such as with one or more electric motors, solenoids, hydraulic systems, pneumatic systems, or other suitable actuating means. Cross support member 134 may be detachable from either or both upper support members 132 for easy storage within housing 52. As with other embodiments described herein, acoustic panel assembly 120 may be made of relatively lightweight materials so as to be readily transportable, and a plurality of acoustic panel assemblies 120 may be placed side by side in order to form an acoustic wall.

Figure 19:
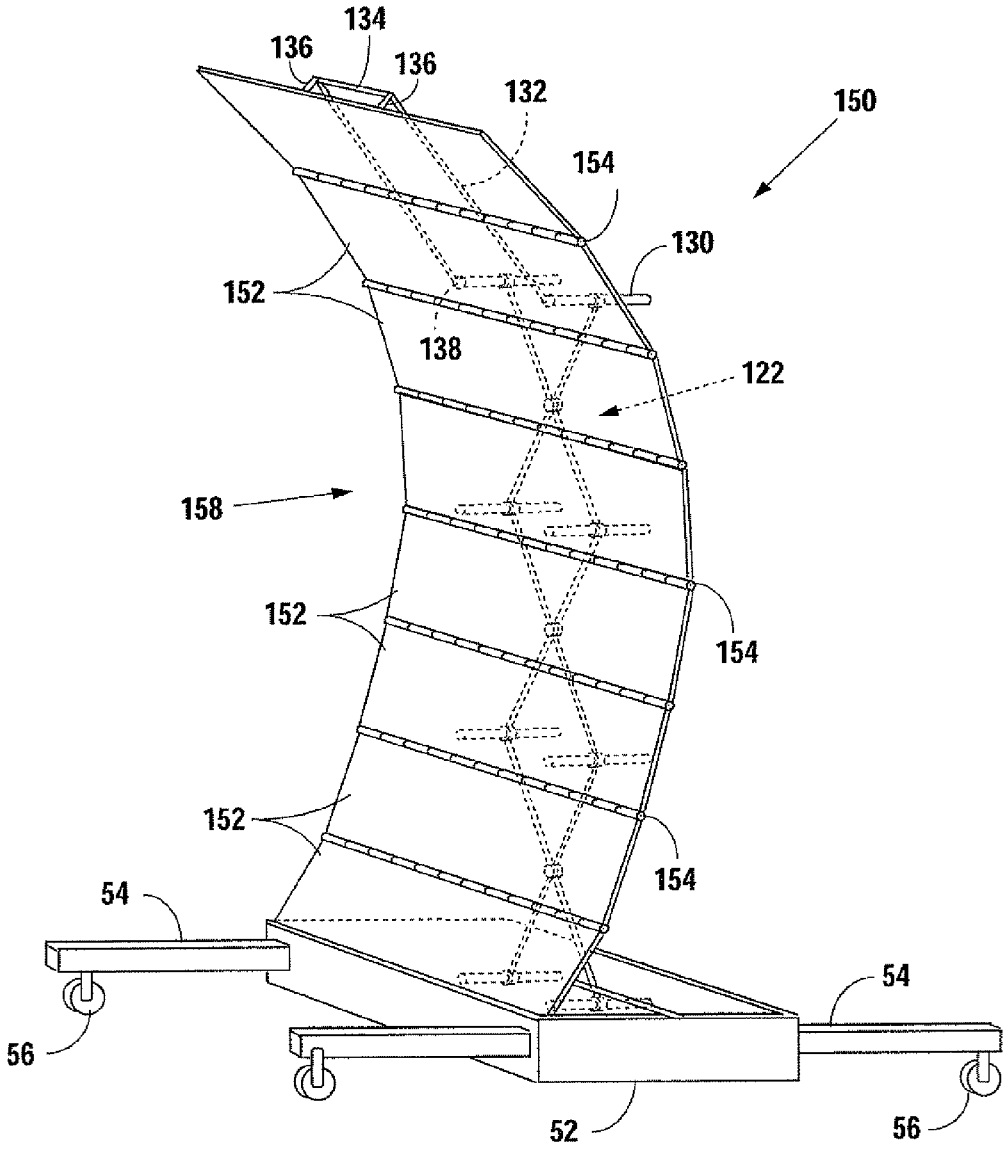
FIG. 19 is a perspective view of yet another alternative embodiment of an acoustic panel assembly in a deployed position.
Figure 20:
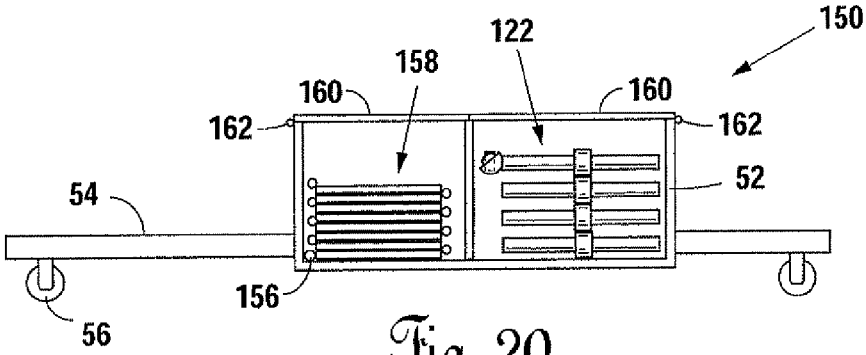
FIG. 20 is a side view of the acoustic panel assembly of FIG. 19 in a retracted position.
Figure 21:
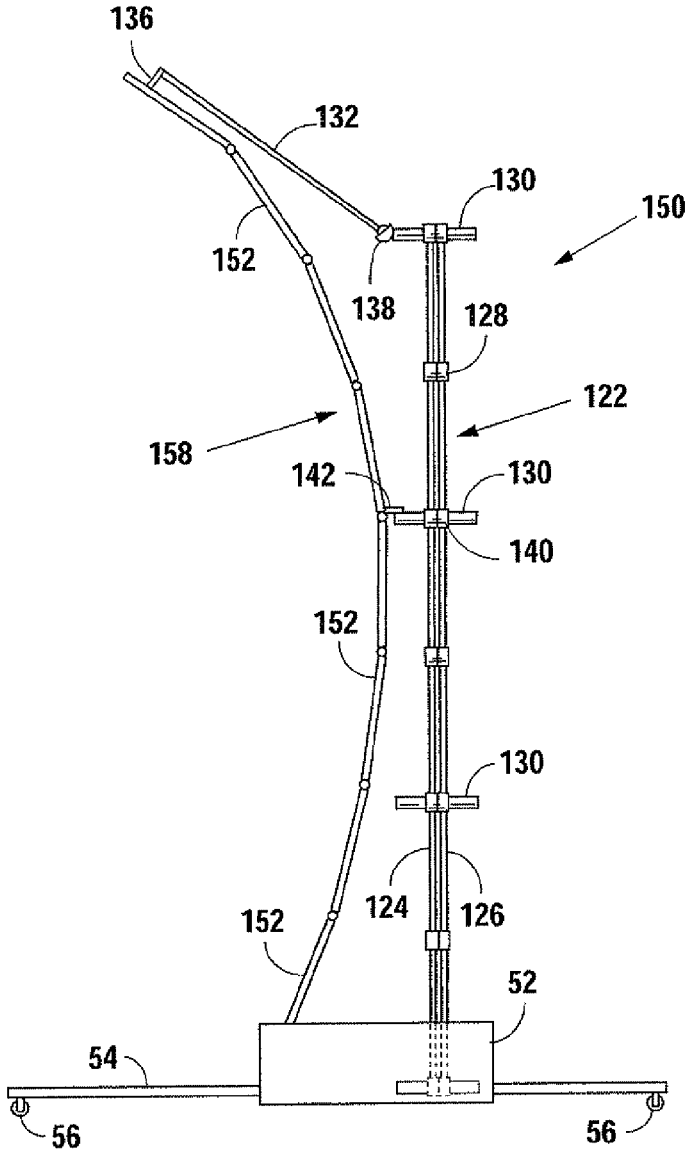
FIG. 21 is a side view of the acoustic panel assembly of FIG. 19.

Referring to FIGS. 19-21, another alternative embodiment of an acoustic panel assembly 150 is shown. Acoustic panel assembly 150 is similar to acoustic panel assembly 120 described above, except a plurality of panels 158 is provided instead of a flexible screen 58. The plurality of panels 158 may have a series of panels 152 that are connected together with a plurality of hinges 154 such that the plurality of panels 158 may be folded upon itself and stowed in housing 52 as shown in FIG. 20. A lower end of the plurality of panels 158 may be attached to housing 52 with one or more pivotal attachments 156 (see FIG. 20), which may comprise one or more hinges or other suitable attachments. As shown in FIG. 20, housing 52 may have one or more covers 160, which may be hinged at one or more hinges 162 or otherwise attached to housing 52. Alternatively, covers 160 may be removable from housing 52 and may or may not be attached to housing 52. As shown in FIG. 21, using one or more intermediate attachments 142, the plurality of panels 158 may be held in any desired position, such as a segmented curve that approximates a parabolic curve, for example, in order to focus sound waves in a desired direction. Again, persons of ordinary skill in the art will appreciate that the plurality of panels 158 may be held in any desired position, and the configuration shown in the drawings is exemplary and not limiting. Acoustic panel assembly 150 may be deployed and retracted by actuating scissor-like support member 122 as described above for assembly 120. As with other embodiments described herein, acoustic panel assembly 150 may be made of relatively lightweight materials so as to be readily transportable, and a plurality of acoustic panel assemblies 150 may be placed side by side in order to form an acoustic wall.

Figure 22:
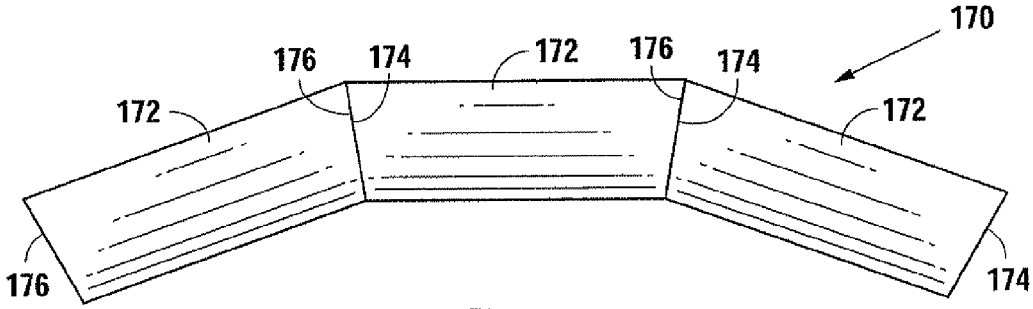
FIG. 22 is a top view of a plurality of panels of acoustic panel assemblies arranged adjacent one another to form an acoustic wall.
Figure 23:
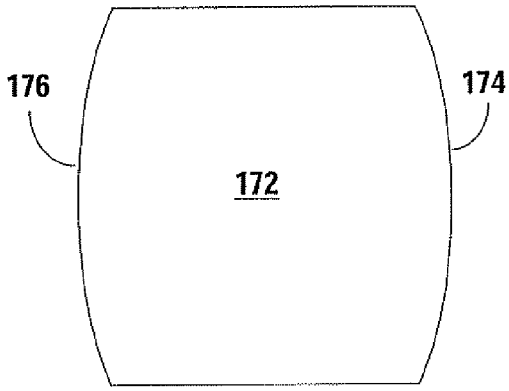
FIG. 23 is a front flat pattern view of a panel of FIG. 22.
Figure 24:
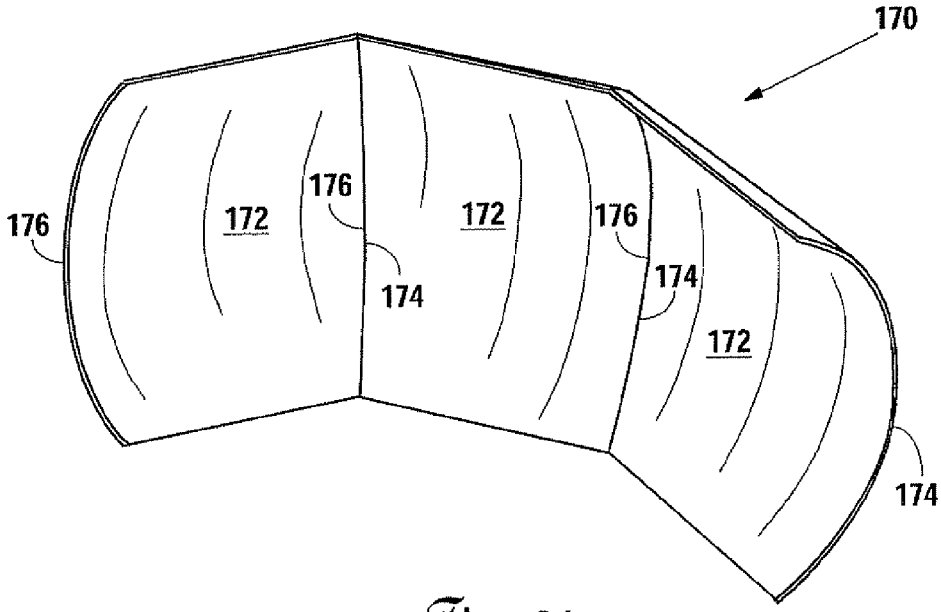
FIG. 24 is a perspective view of the plurality of panels of FIG. 22.

Referring to FIGS. 22-24, various embodiments of acoustic panel assemblies having curved or substantially curved panels, as illustrated, for example, in FIGS. 16, 18, 19, and 21, may be arranged substantially adjacent each other to form an acoustic wall 170 in which the acoustic panel assemblies generally form a segmented arc when viewed from above as illustrated in FIG. 22. For the sake of simplicity and clarity, only panels 172 are illustrated in FIGS. 22 and 24, and the remainders of the acoustic panel assemblies that would be associated with such panels (for instance, housings and support structures) are not shown. In such instances, to avoid the creation of gaps along the sides of each adjacent panel as a result of the side edges of the panels not being in a substantially vertical arrangement, the panels 172 may have a non-rectangular flat pattern as shown in FIG. 23, for example, such that when the panels 172 are placed in a curved position the respective side edges 174, 176 of adjacent panels will abut one another substantially along the entire height of the panels as shown in FIG. 24. Acoustic panel assemblies having panels with side edges that are arranged substantially vertically, such as those illustrated in FIGS. 4, 7, 8, and 12, for example, may readily be arranged in a segmented arc when viewed from above without creating such gaps. Of course, panels for acoustic panel assemblies as described herein may have any desired shape, and gaps between adjacent acoustic panel assemblies may or may not be desired in any particular situation. If desired, in some installations of a plurality of acoustic panel assemblies as described herein, adjacent acoustic panel assemblies may be staggered such that some of the acoustic panel assemblies overlap each other. In such staggered installations, the upper panels, such as panel 14 in FIG. 4 or panel 104 in FIG. 12, for instance, of adjacent acoustic panel assemblies may be placed at different angles with respect to the vertical in order to achieve a substantially curved acoustic wall when viewed from above, similar to the segmented arc arrangement illustrated in FIG. 22.

Persons of ordinary skill in the art will understand that various features of certain embodiments described herein may be substituted in other embodiments described herein. For example, a telescoping support member 62 as described for acoustic panel assemblies 50 and 100 may be substituted for a scissor-like support member 122 as described for acoustic panel assemblies 120 and 150, and vice versa. Other modifications and substitutions will also be readily ascertained by persons of ordinary skill in the art.

Although the foregoing specific details describe certain embodiments of the present invention, persons reasonably skilled in the art will recognize that various changes may be made in the details of this invention without departing from the spirit and scope of the invention as defined in the appended claims and considering the doctrine of equivalents. Therefore, it should be understood that this invention is not to be limited to the specific details shown and described herein.

What is claimed is:

1. An acoustic panel assembly consisting of:

an upper panel, a middle panel, and a lower panel, each of said panels being hingedly connected to another of said panels along an edge, said middle panel and said lower panel being adaptable for placement in an extended position in which said middle panel and said lower panel are substantially co-planar;

wherein said middle panel is hingedly attached to said upper panel and said lower panel;

wherein said upper panel, said middle panel, and said lower panel are substantially rectangular in shape;

an adjustable stand having a base, a central vertical member extending upward from said base, a cross bar extending from said central vertical member and being spaced apart from said base, and a first attachment extending from said cross bar, said first attachment being adaptable for manually and removably mounting said panels on said stand;

wherein said adjustable stand is manually extendable from a retracted position to a raised position;

a second attachment extending from said cross bar, said second attachment being adaptable for holding the upper panel at an angle with respect to said middle panel and said lower panel when said middle panel and said lower panel are in said extended position;

wherein all of said panels are manually detachable from said adjustable stand and foldable into a single compact hingedly connected assembly;

wherein all of said panels are substantially the same size and shape and configured to be substantially parallel and aligned with each other when folded into said single compact hingedly connected assembly;

wherein said first attachment is a pair of J-bolts and said middle panel has a pair of holes or hooks configured for engaging said J-bolts;

wherein said second attachment is adjustable such that said angle is adjustable.

2. The acoustic panel assembly of claim 1 wherein said second attachment has a turnbuckle and an eye bolt.

3. The acoustic panel assembly of claim 1 wherein said adjustable stand has a height of about six feet tall in said retracted position and wherein said panels are rigid.

4. The acoustic panel assembly of claim 1 wherein at least one of said panels has at least one surface feature selected from raised regions and depressed regions.

5. A portable acoustic panel assembly consisting of:

a stand having a base, a telescoping vertical member extending from said base, and a single cross bar extending from said vertical member apart from said base;

an upper panel, a middle panel, and a lower panel, each of said panels being hingedly connected to another of said panels;

wherein said panels are adaptable for placement into a single compact hingedly connected assembly in a substantially flat folded position;

said panels being manually attachable to and removable from said single cross bar;

a first attachment extending from said single cross bar, wherein said first attachment is adapted for manual attachment and removal of the panels from the single cross bar;

wherein said first attachment is a pair of J-bolts and said middle panel has a pair of holes or hooks configured for engaging said J-bolts;

wherein said middle panel and said lower panel are adaptable for placement in an extended position in which said middle panel and said lower panel are substantially co-planar; and a second attachment manually adaptable for holding said upper panel at an angle with respect to said middle panel and said lower panel when said lower panel and said middle panel are in said extended position;

wherein said panels have a total combined weight of approximately 30 pounds and may be manually installed on said single cross bar by one person;

wherein said stand is manually extensible by one person when said panels are attached to said single cross bar.

6. The portable acoustic panel assembly of claim 5 wherein the second attachment is a turnbuckle.

7. An acoustic panel assembly which is manually adjustable and easily moved by one individual, consisting of:

an adjustable stand having a base, a telescoping vertical member extending from said base, and a cross bar extending from said vertical member apart from said base;

wherein said adjustable stand is manually extendable between a retracted position and a raised position;

an upper panel, a middle panel, and a lower panel, each of said panels being hingedly connected to another of said panels along an edge, said middle panel and said lower panel being adaptable for placement in an extended position in which said middle panel and said lower panel are substantially co-planar;

a first attachment connected to said cross bar to which said panels are attachable by hooking to said first attachment, and from which said panels are detachable by unhooking from said first attachment;

wherein said first attachment is a pair of J-bolts and said middle panel has a pair of holes or hooks configured for engaging said J-bolts;

a second attachment adjustable for holding said upper panel at a desired angle with respect to said middle panel and said lower panel when said middle panel and said lower panel are placed in said extended position;

wherein said second attachment is connected to said upper panel and to said cross bar; wherein said second attachment is adjustable prior to manual extension of said adjustable stand;

wherein each of said panels has a height not greater than about 36 inches and a width not greater than about 40 inches and all of said panels collectively weigh no more than about 30 pounds;

wherein said stand is approximately six feet tall in said retracted position;

wherein all of said panels are detachable from said adjustable stand and foldable into a single compact hingedly connected assembly.

8. An acoustic panel assembly comprising:

three manually portable panels comprising an upper panel, a middle panel, and a lower panel, all of said panels having substantially the same size and shape, each of said panels having at least one surface feature adapted for reflecting or deflecting sound waves in a desired direction, said middle panel being hingedly connected to said upper panel and said lower panel along upper and lower edges, respectively, of said middle panel, all of said panels being foldable into a compact hingedly connected folded position in which said panels are substantially parallel to and aligned with each other;

wherein said middle panel has a pair of receptacles;

a manually portable stand comprising a base, a telescoping vertical member extending from said base, and a horizontal cross bar extending from an upper portion of said vertical member, said cross bar having a pair of J-bolt attachments adaptable for manually and removably mounting said panels on said stand by insertion of said J-bolt attachments into said receptacles when said vertical member is in a retracted position; and an attachment having a turnbuckle and an eye-bolt connected to said upper panel and said cross bar, said being adjustable for manually placing said upper panel in a desired angular relationship with respect to said middle panel;

wherein said vertical member is manually extendable and adapted for placing said panels at a desired height in an extended position.

9. The acoustic panel assembly of claim 8 wherein said at least one surface feature is selected from raised regions and depressed regions.

10. The acoustic panel assembly of claim 8 wherein said at least one surface feature is selected from irregular features and patterned features.

11. The acoustic panel assembly of claim 8 wherein said stand is approximately six feet tall in said retracted position.

12. The acoustic panel assembly of claim 11 wherein said panels weigh about 30 pounds total.

* * * * *

UNITED STATES PATENT AND TRADEMARK OFFICE

CERTIFICATE OF CORRECTION

PATENT NO. : 8,091,605 B1
APPLICATION NO. : 11/627331
DATED : January 10, 2012
INVENTOR(S) : Jimmie Ray Melhart It is certified that error appears in the above-identified patent and that said Letters Patent is hereby corrected as shown below:

In claim 8, column 10, line 45, insert -- attachment -- before the word "being".

Signed and Sealed this
Twenty-first Day of February, 2012

David J. Kappos

David J. Kappos
*Director of the United States Patent and Trademark Office*